US006701979B2

(12) United States Patent
Servadei et al.

(10) Patent No.: US 6,701,979 B2
(45) Date of Patent: Mar. 9, 2004

(54) MACHINE FOR FILLING CONTAINERS WITH A LIQUID SUBSTANCE

(75) Inventors: Giovanni Servadei, Faenza (IT); Giancarlo Ori, Calderara di Reno (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/275,014

(22) PCT Filed: Apr. 30, 2001

(86) PCT No.: PCT/IB01/00711

§ 371 (c)(1),
(2), (4) Date: Oct. 30, 2002

(87) PCT Pub. No.: WO01/85594

PCT Pub. Date: Nov. 15, 2001

(65) Prior Publication Data

US 2003/0150513 A1 Aug. 14, 2003

(30) Foreign Application Priority Data

May 5, 2000 (IT) ..... B02000A0255

(51) Int. Cl.[7] ..... B65B 3/04
(52) U.S. Cl. ..... 141/146; 141/90
(58) Field of Search ..... 141/46, 85, 89–91, 141/144–146

(56) References Cited

U.S. PATENT DOCUMENTS 4,667,709 A * 5/1987 Fischer et al. ..... 141/91
4,967,813 A 11/1990 Ponvianne et al.

FOREIGN PATENT DOCUMENTS

| | | |
|---|---|---|
| EP | 0 486 438 A2 | 5/1992 |
| FR | 2 067 499 | 8/1971 |

* cited by examiner

*Primary Examiner*—Gregory Huson
*Assistant Examiner*—Peter deVore
(74) *Attorney, Agent, or Firm*—William J. Sapone; Coleman Sudol Sapone, P.C.

(57) ABSTRACT

In a machine (1) for filling containers with a liquid substance, a rotating head (2) is carried rotatingly by a stationary structure (3) and a liquid substance delivering chamber (4) is made inside the rotating head (2). A plurality of distributors (6) are arranged along the edge of the rotating head (2) for delivering the liquid substance to filling nozzles (7) associated with the rotating head (2). A basin (30) is associated to the stationary structure (3) for collecting a sterilizing liquid introduced into the distributors (6) and flowing in the nozzles (7) for sterilizing, by washing, the distributors (6) and the nozzles (7). The basin (30) is closed by a cover (32), fastened to the rotating head (2).

A plurality of vertical tubes (34) pass tightly through the cover (32) and extend inside the basin (30), so as to be connected to the nozzles (7) and to the distributors (6) by flexible pipes (25A, 25B).

7 Claims, 4 Drawing Sheets

6
18
13
19
10
25A
8
9
11
12

6
9
14
13
10
16
8
9a
18
11
12
160

9
6
18
14
13
19
10
25A
8
11
12
16
160

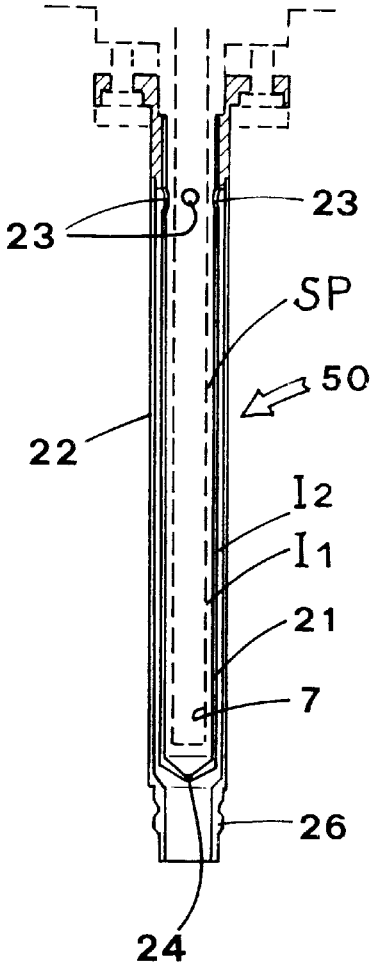
FIG. 3
FIG. 4
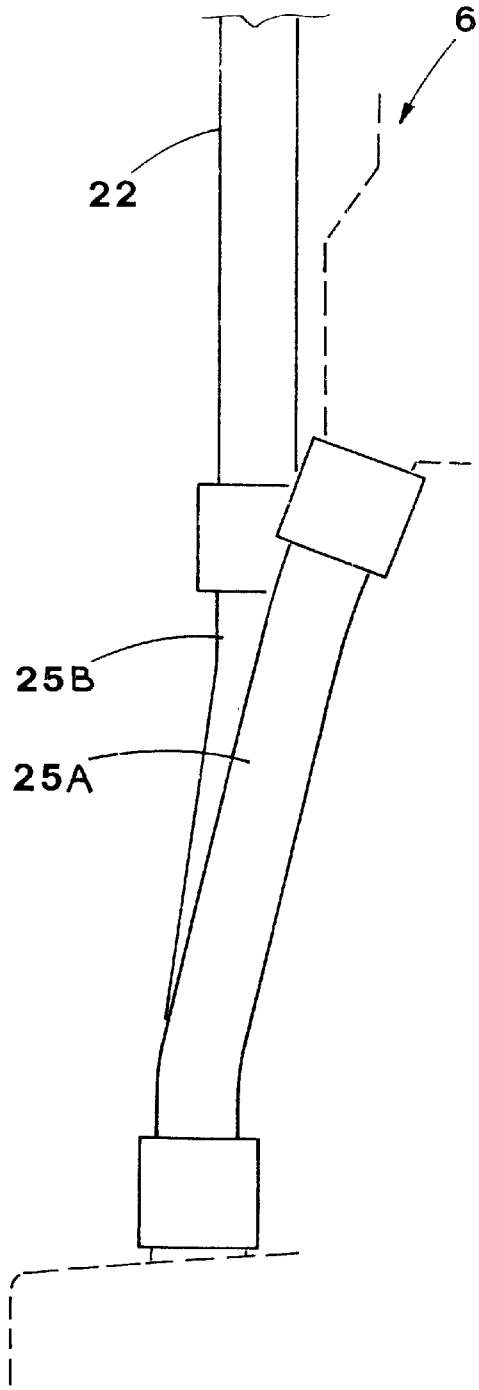

MACHINE FOR FILLING CONTAINERS WITH A LIQUID SUBSTANCE

BACKGROUND OF THE INVENTION

The present invention relates to filling containers, in particular bottles and the like, with liquid substances.

DESCRIPTION OF THE PRIOR ART

In the pharmaceutical or cosmetic industry there are known filling machines which automatically fill bottles with measured quantities of liquid substances.

The above mentioned machines are usually equipped with a rotating head, which is carried by a stationary structure. The head rotates on a vertical axis. A liquid delivering chamber, fed by a suitable duct, is formed inside the head.

The rotating head features, arranged along the edge thereof, syringe-like distributors, which deliver the liquid substance to corresponding filling nozzles, associated with the rotating head by suitable three-way valves controlling the liquid substance passage.

The distributors are aimed, in two different moments, at batching liquid and at feeding the batched liquid to the nozzles.

The machines for filling bottles must be periodically sterilized by washing the areas, which are in contact with liquid substances, in particular after a working cycle is finished and when the liquid substance for filling the bottles is to be changed.

The machine is sterilized by feeding a suitable sterilizing liquid or steam to the distributors and to the nozzles, via the above areas being in contact with liquid substances, i.e. the distributing chamber of the rotating head.

The problem related to the sterilization operation concerns the collection and disposal of the sterilizing liquid.

Currently, in order to sterilize, it is necessary to stop the machine and to join thereto a basin, which conveys the sterilizing liquid going out of the areas being sterilized.

The open-topped collection basin usually includes two semi-circular portions which are fastened removably to the machine.

When the sterilization is completed, the collection basin is emptied and removed from the machine.

Besides obvious hygienic problems and environmental pollution risk, the above solution is very expensive, mainly because of operator labor.

Actually, the assembling and disassembling of the basin collecting the sterilizing liquid requires a lot of time, during which the machine does not work.

SUMMARY OF THE INVENTION

The object of the present invention is to solve the above problem by proposing a machine for filling bottles and the like, which allows to perform sterilizing operations in a simple and rapid way.

Another object of the present invention is to propose a machine the sterilization of which can be performed in an extremely efficient way, in absolutely hygienic conditions and without causing environment pollution.

A further object of the present invention is to propose a machine, in which sterilization operations require a reduced use of operators labor.

A still further object of the present invention is to propose a machine the construction of which is very simple and which is functional and versatile.

The above mentioned objects are obtained in accordance with the contents of the claims, by a machine for filling containers with a liquid substance, the machine including:

- a rotating head carried rotatingly by a stationary structure;
- a liquid substance delivering chamber made inside said a rotating head;
- at least one distributor arranged along the edge of said rotating head for delivering the liquid substance;
- at least one filling nozzle associated with said rotating head and connected with said distributor;
- the machine being characterized in that it includes:
  - container means associated to said stationary structure for collecting a sterilizing liquid introduced into said distributor and flowing in the corresponding filling nozzle;
  - covering means applicable to said container means for closing tightly said container means;
  - conveying means for conveying said sterilizing liquid substance, said conveying means being connected to said covering means and associated to said nozzle and to said distributor for connecting tightly said nozzle and said distributor with said container means.

DESCRIPTION OF THE DRAWINGS

The characteristic features of the present invention will be pointed out in the following description of a preferred, but not only embodiment, with reference to the enclosed drawings, in which:

FIG. 3 shows a vertical section view of a nozzle of the filling machine;

FIG. 4 shows a connection of the distributing device of FIG. 3 and the nozzle to a basin, associated to the machine for collecting the sterilizing liquid;

BEST MODE OF CARRYING OUT THE INVENTION

Figure 1:
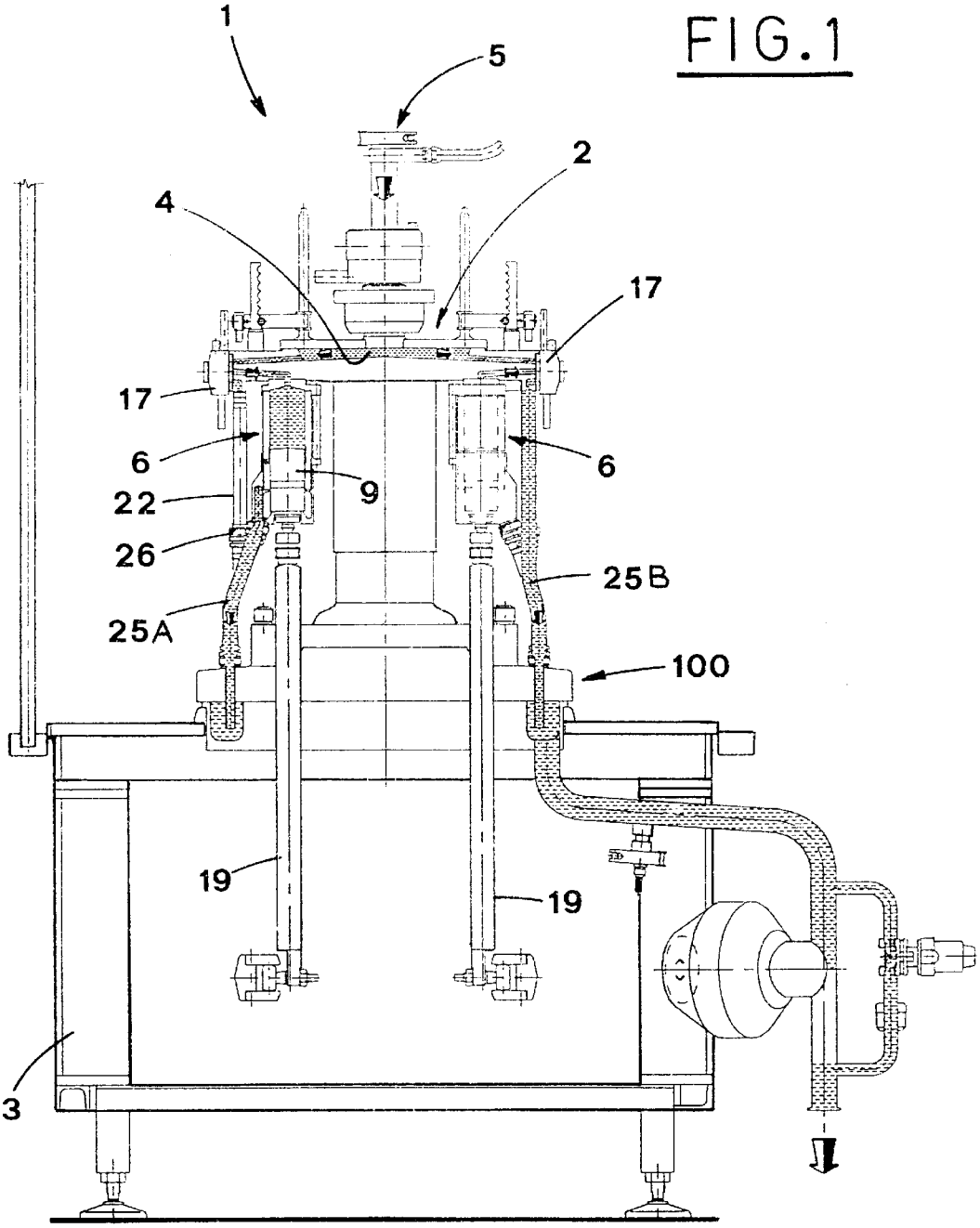
FIG. 1 shows a schematic vertical section view of a preferred embodiment of the proposed machine for filling bottles and the like with liquid substances.

With reference to the above figures, reference numeral 1 indicates the machine for filling bottles with a liquid substance.

The machine 1 includes a head 2 rotating on a vertical axis, The head 2 is carried by a stationary structure 3 forming the machine base.

Inside the rotating head 2 there is formed a liquid substance delivering chamber 4. A duct 5 feeds the chamber 4 with the liquid substance.

Along its edge, the rotating head 2 features a plurality of syringe-like distributors 6 which deliver the liquid substance to corresponding filling nozzles 7 (FIG. 3) mounted to the rotating head, via suitable three-way valves 17 for controlling the liquid substance flow.

The syringe-like distributors 6 include a cylindrical sleeve 8, in which a piston 9 slides.

Figures 2A, 2B, 2C:
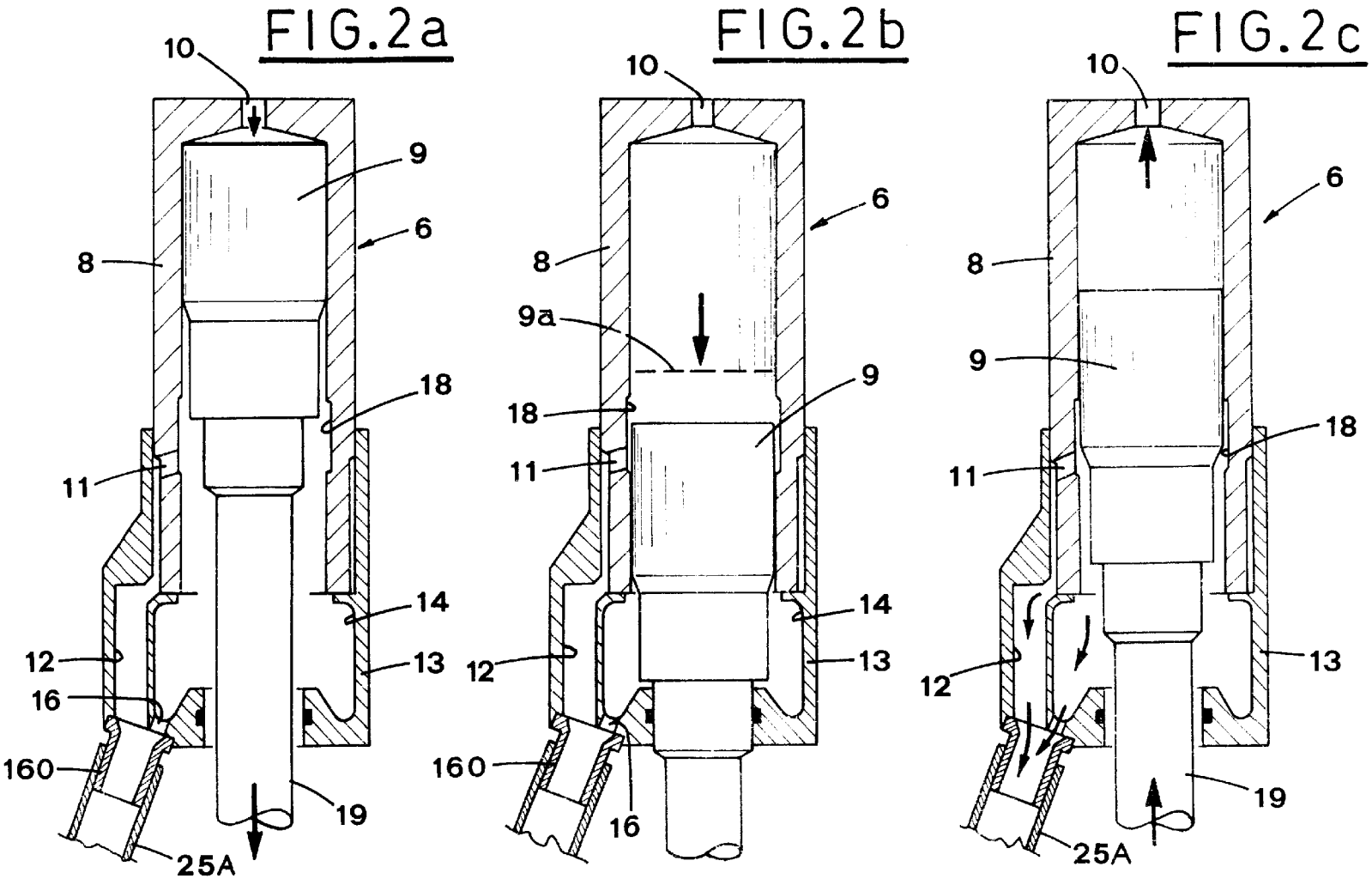
FIGS. 2*a*, 2*b* and 2*c* show vertical section views of a distributing device of the filling machine, in different operation steps.

The upper part of the sleeve 8 features a hole 10, through which the liquid substance is delivered (FIG. 2*a*).

The lower part of the cylindrical sleeve 8 features a ring-like area 18 with widened diameter, in correspondence of which there is made at least one discharge hole 11.

The discharge hole 11 communicates with a duct 12 formed in a cap 13 covering the base of the cylindrical sleeve 8.

The stem 19 of the piston 9 passes axially and tightly through the cap 13.

Under the cylindrical sleeve 8, the cap 13 defines a chamber 14. The bottom of the chamber 14 communicates with the duct 12 through a discharge hole 16.

A connecting element 160 is fastened to the end of the duct 12 (FIGS. 2*a,* 2*b* and 2*c*).

The top of each nozzle 7 communicates with a corresponding valve means 17 (see FIG. 1.

The nozzle 7 is introduced into a collar 21, in coaxial relation therewith.

The lower part of the collar 21 is closed and the upper part thereof is fastened tightly to the rotating head.

The collar 21 is introduced into an outer tubular sheath 22, fastened tightly to the collar 21 and equipped, in its lower part, with a joint 26.

The upper part of the collar 21 features a series of holes 23, and the lower part of the collar 21 features a hole 24 of small diameter, which allows to drain possible accumulated condensed liquid (FIG. 3).

The holes 23 connect a first cylindrical space I1, defined between the outer cylindrical edge surface SP of the nozzle 7 and the collar 21, with a second cylindrical space I2 between the collar 21 and the tubular sheath 22.

Substantially, the collar 21 (and the relative lower hole 24 and the upper hole 23) together with the tubular sheath 22 (with the relative joint 26) form a device 50, which allows to sterilize the nozzle 7 by washing, during the stops for maintenance operation of the machine 1.

In particular, the inner channel as well as the outer cylindrical edge surface of the nozzle 7 are washed with a suitable sterilizing liquid introduced into the distributor 6 and going out from the nozzle 7 and flowing along the above first cylindrical space I1 and second cylindrical space I2, as will be explained later on.

Figure 5B:
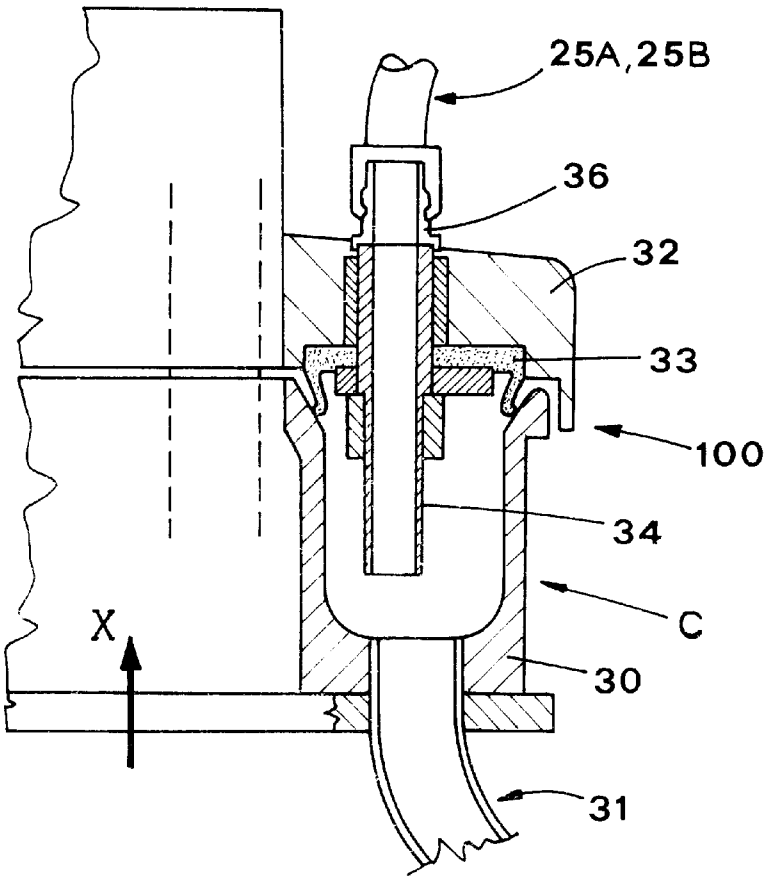
FIGS. 5*a* and 5*b* show vertical section views of the above sterilizing liquid collecting basin, in an opening and closing position, respectively.
Figure 5A:
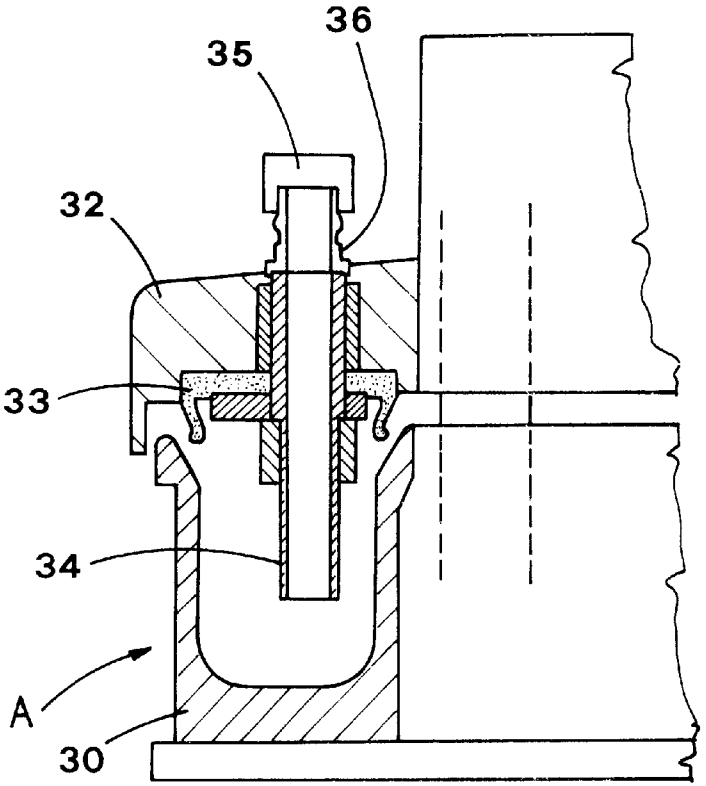

A substantially ring-like basin 30 for collecting the sterilizing liquid, is associated to the stationary structure 3 and connected to a discharge channel 31 (see FIGS. 5*a,* 5*b*).

The basin 30 can be closed by closing means 100 including a cover 32, fastened to the rotating head 2 and equipped with a sealing plate 33.

A plurality of vertical tubes 34 pass tightly through the cover 32 and extend inside the basin 30, in correspondence to the above mentioned distributors 6 and sterilizing devices 50, to which they are connected by flexible pipes 25A, 25B (FIG. 4).

At their tops, the vertical tubes 34 feature respective joints 36, which are to be connected to the above flexible pipes 25A, 25B and are closed during the production cycle by relative plugs 35.

The basin 30 is operated, by suitable operating means, not shown, to move vertically (arrow X in FIG. 5*b*) between a lowered opening position A (FIG. 5*a*) and a raised closing position C (FIG. 5*b*), in which it goes in abutment against the seal 33.

During normal operation conditions, the basin 30 is situated in the lowered position A, so as to avoid rubbing of the seal 33, rotated together with the rotating head 2, on the basin 30.

When the sterilization is to be performed by washing of the machine 1, during normal machine 1 maintenance operations, the basin 30 is moved to the raised closing position C, in which it goes in abutment against the seal 33.

Moreover, it is necessary to join each nozzle 7 with the relative sterilization device 50, in a way as described above.

Finally, the vertical tubes 34 are connected to the distributors 6 and sterilization devices 50 by the flexible pipes 25A, 25B (FIG. 4), which feature joints, which are complementary to the joints 160, 26, 36 of the distributors 6, of the sterilization devices 50 and of the covering means 100.

In this configuration, the sterilization is performed by feeding a suitable sterilizing liquid to the areas in contact with liquid substances, i.e. the delivering chamber 4 of the rotating head 2, the distributors 6 and the nozzles 7.

The sterilizing liquid is sucked into the distributors 6 by the motion of the piston 9, which moves, starting from the top dead center (FIG. 2*a*).

The piston 9 is imposed a stroke, whose amplitude is bigger than the maximum amplitude of the stroke in normal operation condition, indicated with broken line 9*a* in FIG. 2*b,* so as to uncover the ring-like area 18, having widened diameter, of the cylindrical sleeve 8, which thus gets in contact with the sterilizing liquid.

During the subsequent upwards stroke of the piston 9, the sterilizing liquid is pumped through the hole 10 and the sterilizing liquid which filled the area 18, goes down along the cylindrical sleeve 8 up to the chamber 14 of the cap 13.

Thus, the whole cylindrical sleeve 8 is in contact with the sterilizing liquid.

The sterilizing liquid, pumped by the distributors 6, flows into the nozzles 7, from which it goes out, so as to go upwards through the first cylindrical space I1 and, to go down again by the upper holes 23 and through the second cylindrical space I2, so as to be conveyed to the basin 30 by the relative pipe 25B, according to a continuous feeding flow of the sterilizing liquid.

Finally, the sterilizing liquid collected in the basin 30 is discharged through the discharge channel 31.

Therefore, the proposed machine allows a simple and rapid sterilization operation by washing.

Actually, in order to perform the sterilization step, it is sufficient, when the machine 1 is stopped, to connect each nozzle 7 with the relative sterilizing device 50, to close the collecting basin 30, fastened to the structure of the machine and to connect, by the flexible pipes 25A, 25B, the distributors 6 and the tubular elements with the joints 36 of the basin cover 32.

This causes a reduced external time and minimal use of manpower, which results in costs reduction and productivity increase.

The sterilization performed by the proposed machine takes place in absolutely hygienic conditions and without causing environment pollution.

It is understood that what above, has been described as a pure, not limitative example, therefore, possible variants of the invention remain within the protective scope of the present technical solution, as described above and claimed hereinafter.

What is claimed is:

1. A machine (1) for filling containers with a liquid substance, the machine including:

a rotating head (2) carried rotatingly by a stationary structure (3);

a liquid substance delivering chamber (4) made inside said a rotating head (2);

at least one distributor (6) arranged along the edge of said rotating head (2) for delivering the liquid substance;

at least one filling nozzle (7) associated with said rotating head (2) and connected with said distributor (6);

the machine being characterized in that it includes:

container means (30) associated to said stationary structure (3) for collecting a sterilizing liquid introduced into said distributor (6) and flowing in the corresponding filling nozzle (7);

covering means (100) applicable to said container means (30) for closing tightly said container means (30);

conveying means (34,25A,25B) for conveying said sterilizing liquid substance, said conveying means being connected to said covering means (100) and associated to said nozzle (7) and to said distributor (6) for connecting tightly said nozzle (7) and said distributor (6) with said container means (30).

2. A machine, according to claim 1, wherein said container means (30) include:

a basin (30) collecting said sterilizing liquid substance and said covering means (100) include a cover (32) fastened to said rotating head (2);

operating means for moving said basin (30) between a lowered opening position (A) and a raised closing position (C), in which it goes in abutment against said cover (32);

a seal (33) interposed between said basin and said cover.

3. A machine, according to claim 2, wherein said cover (32) is equipped with a seal (33), substantially a plate-like seal engaging edges of said basin (30).

4. A machine, according to claim 1, wherein said distributor (6) includes:

a cylindrical sleeve (8);

a piston (9) sliding inside said sleeve (8);

a ring-like area (18) defined in a lower part of said cylindrical sleeve (8);

at least one discharge hole (11) made in said ring-like area (18);

a duct (12) connected with said discharge hole (11) and connected to said container means (30) by said conveying means (25A).

5. A machine, according to claim 4, wherein said duct (12) is defined by a cap (13), which incorporates the base of said cylindrical sleeve (8), with a stem (19) of said piston (9) passing axially and tightly through said cap (13), said cap (13) defining, under said cylindrical sleeve (8), a chamber (14), set in communication with said duct (12) through a discharge hole (16).

6. A machine, according to claim 1, further including a device (50) for washing each of said filling nozzles (7), said device (50) including:

a collar (21) with a lower part closed and with an upper part fastened tightly to said rotating head (2), said collar (21) being coupled with the nozzle (7);

a first space (I1) defined between the outer cylindrical edge surface (SP) and said collar (21), with a lower part of said first space (I1) communicating with said nozzle (7);

a tubular sheath (22) with an upper part fastened tightly to said rotating head (2), said tubular sheath (22) containing said collar (21), said tubular sheath (22) together with said collar (21) defining a second space (I2) set in communication with said first space (I1) by at least one through hole (23) made in the upper part of said collar (21);

said tubular sheath (22) forming in its lower part a joint (26) for connecting with said conveying means.

7. A machine, according to claim 6, wherein a hole (24) of small diameter, is made in the lower head of said collar (21), so as to allow to drain possible accumulated condensed liquid.

* * * * *